US007083435B2

(12) United States Patent
Lohr

(10) Patent No.: US 7,083,435 B2
(45) Date of Patent: Aug. 1, 2006

(54) ELECTRICAL CONNECTOR

(75) Inventor: Markus Lohr, Nieheim (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 0 days.

(21) Appl. No.: 11/062,626

(22) Filed: Feb. 23, 2005

(65) Prior Publication Data

US 2005/0186813 A1 Aug. 25, 2005

(30) Foreign Application Priority Data

Feb. 23, 2004 (DE) ..... 10 2004 009 071

(51) Int. Cl.
*H01R 12/00* (2006.01)

(52) U.S. Cl. ..... 439/83; 439/79

(58) Field of Classification Search ..... 439/79, 439/83

See application file for complete search history.

(56) References Cited

U.S. PATENT DOCUMENTS 3,596,235 A * 7/1971 Teurlings ..... 439/748
4,732,565 A * 3/1988 Ito et al. ..... 439/79
5,030,107 A * 7/1991 Moon ..... 439/62
5,224,866 A * 7/1993 Nakamura et al. ..... 439/81
5,257,948 A * 11/1993 Peterson ..... 439/571
5,520,545 A * 5/1996 Sipe ..... 439/65
5,588,844 A * 12/1996 Sipe ..... 439/65
5,975,920 A 11/1999 Oberstarr
6,328,600 B1 12/2001 Fujiki et al.
6,422,878 B1 7/2002 Pape et al.

FOREIGN PATENT DOCUMENTS

DE 39 11 108 A1 10/1990

* cited by examiner

*Primary Examiner*—Ross Gushi
(74) *Attorney, Agent, or Firm*—David S. Safran

(57) ABSTRACT

An electrical connector for surface mounting on circuit boards has a housing and at least two contact elements, the contact elements each have a contact leg and a solder terminal leg arranged essentially perpendicularly to each other. The contact legs project into a receiving space in the housing and the solder terminal legs run along a first outer side of the housing. Both horizontal and vertical plug-in directions are obtainable by an end of the solder terminal legs being connected in one piece to a second solder terminal leg, the second solder terminal legs running perpendicular to the first solder terminal legs and parallel to the contact legs along a second outer side of the housing, and by at least one projection being provided on the side of the first solder terminal legs and/or the second solder terminal legs for making electrical contact with the circuit board.

11 Claims, 2 Drawing Sheets

ELECTRICAL CONNECTOR

BACKGROUND OF THE INVENTION

1. Filed of Invention

The invention relates to an electrical connector for surface mounting on circuit boards, with a housing and with two contact elements, the contact elements each having one contact leg and one solder terminal leg arranged perpendicularly thereto, and the contact legs each projecting into a receiving space in the housing and the solder terminal legs each running along a first outer side of the housing.

2. Description of Related Art

Electrical connectors are used in electrical terminals together with the corresponding attachment plugs for connecting an electrical conductor to a circuit board. Depending on the embodiment, the electrical connectors can be made as a socket part or as a plug part. Since the electrical connector is connected mechanically and electrically to the circuit board, while an electric line is connected to the corresponding attachment plug, the stationary electrical connector, as a result of its attachment to the circuit board, is also often called the base body. Various embodiments of electrical connectors and the corresponding attachment plugs, i.e., different base bodies and different plug parts, are known, for example, from the Phoenix Contact Catalog, "COMBICON 2000," pages 84 ff. Here, the different plug parts differ especially by the different connection possibilities for the conductors which are to be connected. Thus, plug parts with screw, spring force, crimp and insulation displacement contacts are known. Conversely, the connectors and the base bodies differ especially in whether the contact element as the contact leg has a pin contact or a socket contact, the embodiment with the pin contact being the standard version. If the electrical connector has a pin contact as the contact leg, the connector is made as a socket part into which the attachment plug, which has a socket contact, is inserted.

For electrical connection of the electrical connector to at least one printed conductor of a circuit board, the known contact elements have at least one solder pin which is inserted into the hole provided in the circuit board and is then soldered in it. To do this, generally, the hole is filled beforehand with a solder paste, and then, the solder pin is electrically connected to the corresponding printed conductor by means of reflow soldering.

To simplify automatic assembly of circuit boards with electrical components, in past years, so-called surface mount technology (SMT) was developed as a replacement for conventional soldering-in technology. In this technology, the electronic components with their terminal pins are placed on the surface area of the circuit board, which area is covered with a solder paste. Then, the solder paste is melted by means of infrared radiation to produce the desired electrical connection between the electronic component and the circuit board (See, European Patent Application EP 0 743 716 B1 and corresponding U.S. Pat. No. 5,975,920).

This surface soldering technology is currently also used for electrical connection of electrical connectors to a circuit board. An electrical connector with which contact can be made by means of the above described surface mount technology on a circuit board is known from German Patent DE 100 09 215 C1 and corresponding U.S. Pat. No. 6,422,878. This electrical connector has a host of contact elements which are arranged in an insulating body and which each have a plug-in contact end and a solder terminal end. In the finish-mounted state, the solder terminal end which is designed for electrical mounting on the corresponding solder surface of a circuit board is made essentially perpendicular to the plug-in contact end. To do this, the solder terminal ends of the originally straight contact elements, which have a constriction in the area between the plug-in contact end and the solder terminal end, after insertion into the housing, are bent in two steps by means of special tools. This is intended to achieve an alignment of the solder terminal ends that is as coplanar as possible to the circuit board surface so that unobjectionable soldering can be ensured.

SUMMARY OF THE INVENTION

Proceeding from the above described electrical connector, a primary object of the present invention is to provide an electrical connector which can be used in a manner that is as versatile as possible, which can be easily produced, and which ensures reliable soldering even if a host of contact elements are located next to one another on the circuit board.

This object is essentially achieved in the initially described connector, first of all, in that the solder terminal legs are each connected on one end in one piece to a second solder terminal leg, the second solder terminal legs each running perpendicular to the first solder terminal legs and parallel to the contact legs along the second outer side of the housing, and that, on the side of the first solder terminal legs and/or the second solder terminal legs opposite the housing, at least one projection for making a respective electrical contact with the circuit board is provided.

The electrical connector of the invention can be mounted selectively on the circuit board by the execution of the second solder terminal legs which are aligned perpendicularly to the first solder terminal legs such that a plug-in direction which is parallel to the circuit board axis or a plug-in direction which is vertical to the circuit board axis for an attachment plug is possible.

If the electrical connector is mounted on the circuit board with the first solder terminal legs, the contact legs are aligned perpendicular to the circuit board axis so that a corresponding attachment plug can be connected to the electrical connector in the plug-in direction vertically to the circuit board axis. Conversely, if the electrical connector is mounted on the circuit board with the second solder terminal legs, a plug-in direction parallel to the circuit board axis is possible. The configuration of the contact element in accordance with the invention with a second solder terminal leg has thus cut the required number of types of electrical connectors in half without reducing the available diversity of variations.

The execution of at least one projection for making electrical contact makes it possible for only spot or small-area soldering to be necessary instead of soldering the corresponding solder terminal leg over its entire surface. Preferably, both on the first solder terminal leg and also on the second solder terminal leg, there are at least two projections for making electrical contact, the projections being arranged uniformly distributed over the length of the solder terminal legs. In this way, tilting of the contact element and thus also of the electrical connector when placed on the circuit board is prevented.

According to one especially preferred configuration of the invention, the contact elements are made as stampings. This ensures that all contact elements in one housing are made the same, especially the solder terminal legs of the individual contact elements running exactly parallel to one another. This ensures that even for a host of contact elements located next to one another, all solder terminal legs of the individual contact elements can be soldered without problems on the circuit board.

In order to prevent unwanted detachment of the electrical connector from the circuit board when the corresponding attachment plug is withdrawn, according to one advantageous configuration of the invention, on the side of the second solder terminal leg facing the housing, at least one catch lug is formed. Additionally, on the second outer side of the housing, a corresponding catch projection is formed. The catch lug and the catch projection are aligned relative to one another such that withdrawal of the housing from the contact element when the attachment plug is removed is prevented by the catch projection engaging the catch lug.

Preferably, the electrical connector is made such that there are a host of contact elements in the housing so that the electrical connector can also be called a plug strip. The individual contact legs can be arranged spaced apart from one another, either in receiving spaces which are separated from one another by housing partitions, or in a common receiving space. Then, with a plug-in process with a corresponding attachment plug strip, a host of electrical lines can be connected by such a plug strip to a corresponding number of printed conductors of a circuit board. In particular, there is a plurality of possibilities for embodying and developing the electrical connectors of the invention. In this regard reference is made the detailed description below of one preferred embodiment in conjunction with the drawings.

DETAILED DESCRIPTION OF THE INVENTION

Figure 1:
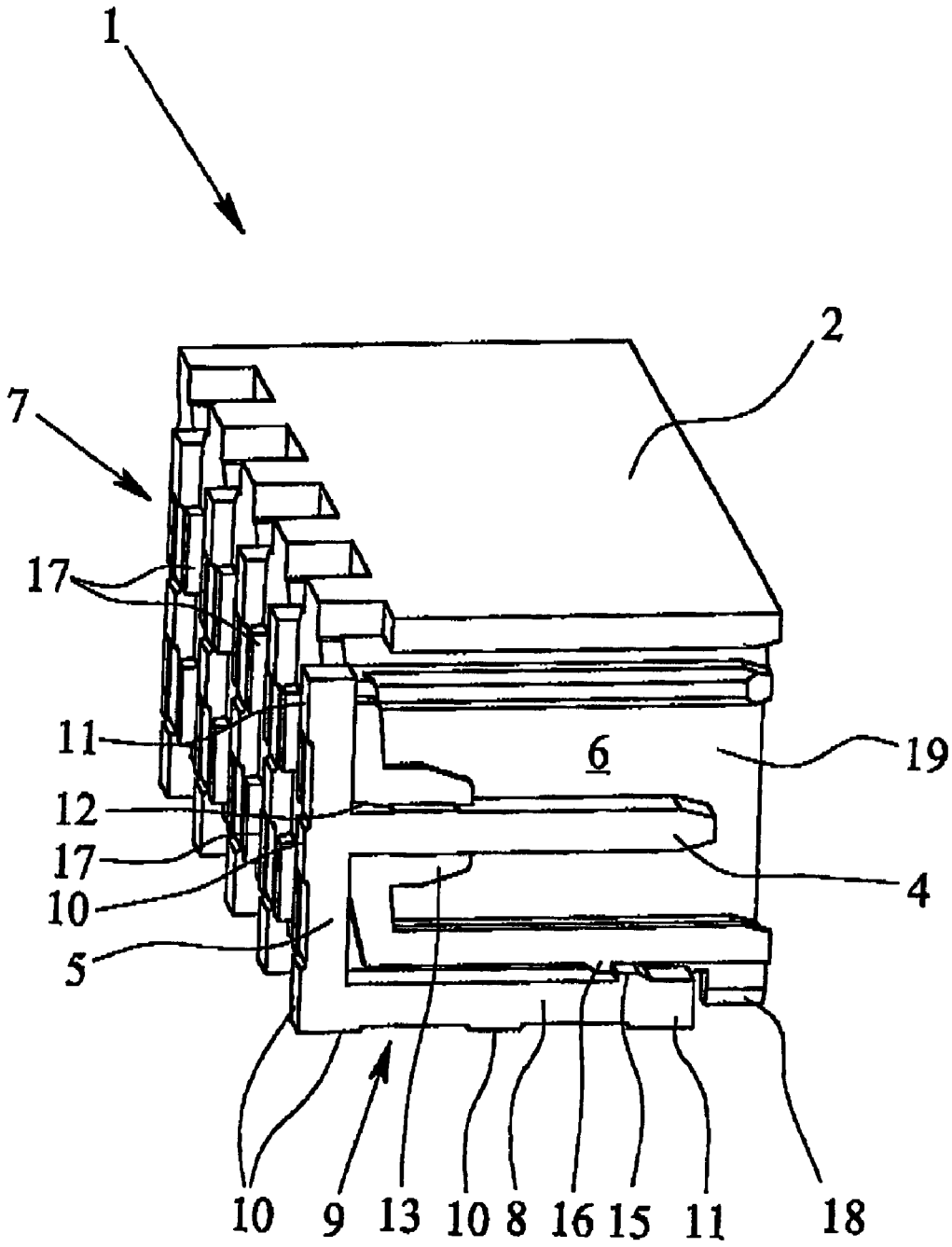
FIG. 1 shows one embodiment of the electrical connector in accordance with the invention, with one side wall omitted for the sake of representation.

FIG. 1 shows an electrical connector 1 for surface mounting on a circuit board (not shown) and which has a housing 2 and a plurality of contact elements 3, in FIG. 1 simply one contact element 3 being shown. For illustration of the contact element 3, which is shown separately in FIG. 2, the outer sidewall of the housing 2 has been omitted in the electrical connector 1 as shown in FIG. 1.

The contact element 3, which is produced by stamping, has a contact leg 4 and a solder terminal leg 5 which is connected to it in one piece, the contact leg 4 and the solder terminal leg 5 which are arranged perpendicular to one another. The contact leg 4, which in this embodiment is made as a pin contact, but likewise also can be made as a socket contact which is tulip-shaped, for example, projects into a receiving space 6 which is formed by the housing 2 and into which a corresponding attachment plug with a corresponding socket contact can be inserted. While the contact leg 4 is thus used for electrical connection to the corresponding attachment plug, the solder terminal leg 5, which runs along the first outer side 7 of the housing 2, is used for electrical connection of the contact element 3 to the printed conductor of a circuit board. If the electrical connector 1 is mounted on the circuit board with the solder terminal leg 5, the contact leg 4 is aligned perpendicular to the circuit board axis, so that a corresponding attachment plug can be inserted into the electrical connector 1 in a direction that is normal to the circuit board axis.

In addition to the above described first solder terminal leg 5, the contact element 3 has a second solder terminal leg 8. Terminal leg 8 is formed in one piece with the first solder terminal leg 5 on one of it. The second solder terminal leg 8 is aligned parallel to the contact leg 4 and perpendicular to the first solder terminal leg 5 and runs along the second outer side 9 of the housing 2. If, at this point, the electrical connector 1 is mounted on a circuit board with the second solder terminal leg 8, the connector 1 has a plug-in direction parallel to the circuit board axis, i.e., a corresponding attachment plug can be inserted parallel to the circuit board axis into the housing 2 of the connector 1.

Producing the contact elements 3 as stampings results in that the two solder terminal legs 5 and 8 are aligned exactly perpendicular to one another. Moreover, it is ensured that all contact elements 3 of a connector 1 are made exactly alike so that when the connector 1 is placed on the circuit board, all solder terminal legs 5 or 8 run exactly parallel to the circuit board, so that reliable contact-making of all contact elements 3 is ensured.

Figure 2:
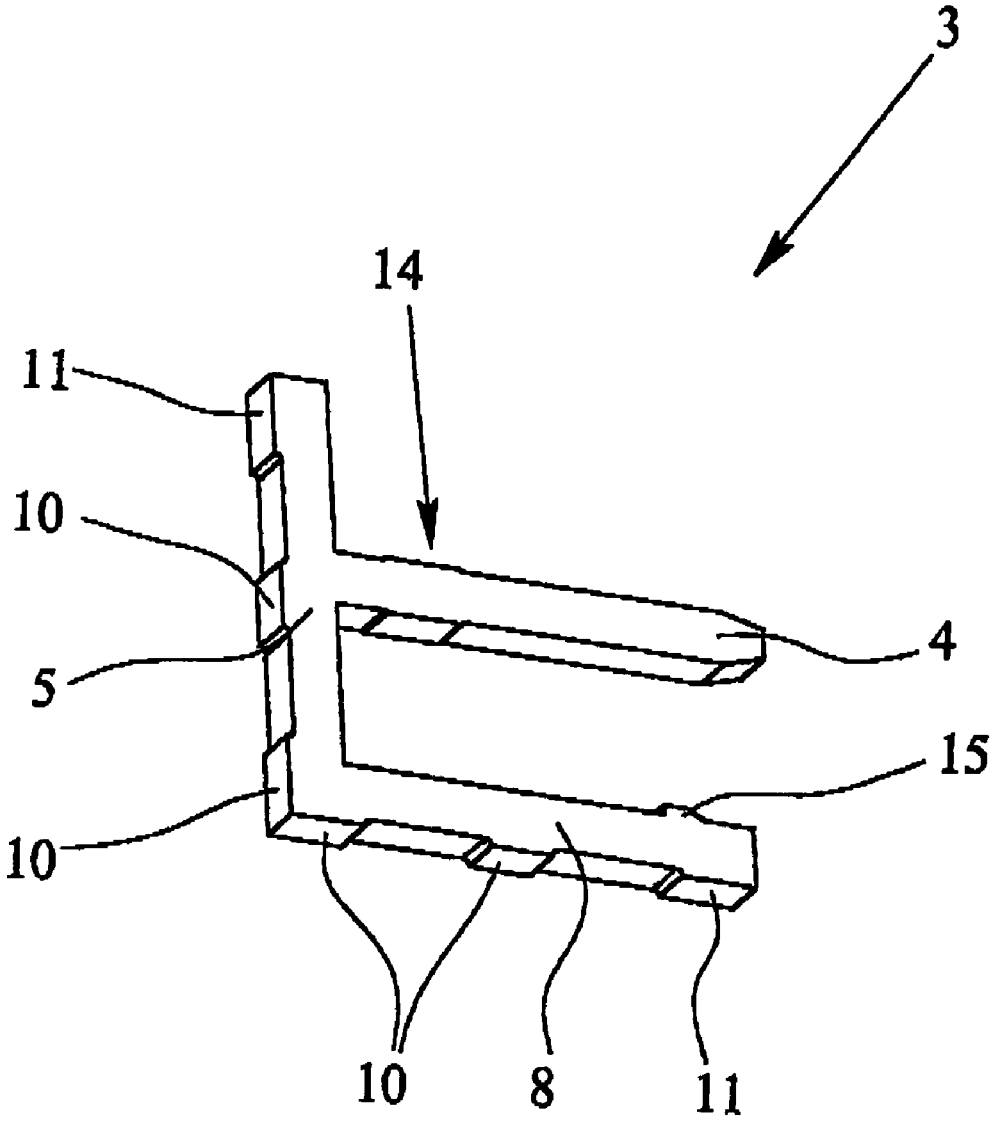
FIG. 2 shows one embodiment of a contact element for use in an electrical connector.

In the embodiment of a contact element 3 shown in FIGS. 1 & 2, both on the first solder terminal leg 5 and also on the second solder terminal leg 8, respectively, two projections 10 are formed which are used for electrical contact-making of the contact element 3 with a printed conductor of the circuit board. The execution of the projections 10 thus fixes the areas of the solder terminal legs 5, 8 on which soldering of the contact element 3 on the circuit board takes place.

In addition to the two aforementioned projections 10 for electrical contact-making, the two solder terminal legs 5, 8 each have another projection 11 which is used for mechanical fixing to the circuit board. The two projections 11 are each made on the end of the solder terminal legs 5, 8 which is away from the common end of the solder terminal legs 5, 8, i.e., the two projections 11 are located on the outside. For mechanical fixing of the connector 1 on a circuit board, then, there are depressions in the circuit board which correspond to the projections 11. As the figures show, the projections 10, 11 are distributed uniformly over the length of the first solder terminal leg 5 and the second solder terminal leg 8, by which tilting of the contact element 3 is prevented as it is placed on the circuit board.

Since, as was stated above, the contact leg 4 of the contact element 3 projects into the receiving space 6 of the housing 2, while the first solder terminal leg 5 runs along the first outer side 7 of the housing 2, in the first outer side 7 of the housing 2, a hole 12 is formed for routing through the contact leg 4. The hole 12 is connected to a tap 13 which projects into the receiving space 6 and by which the contact leg 4 and thus the contact element 3 are fixed. To do this, the contact leg 4 has a widened fixing area 14 and the tap 13 has a corresponding inside contour.

Additional fixing between the housing 2 and the contact element 3 is provided by a catch lug 15 that is located on the side of the second solder terminal leg 8 which faces the housing 2, and a corresponding catch projection 16 which is made on the second outer side 9 of the housing 2. The fixing means which is formed from the catch lug 15 and catch projection 16 prevents the housing 2 from being withdrawn from the contact element 3 at the same time as the attachment plug is removed from the connector 1. Movement of the housing 2 opposite the plug-in direction is prevented by the catch projection 16 adjoining the catch lug 15.

Ribs 17 are formed on the first outer side 7 of the housing 2 and a projection 18 is molded on the second outer side 9 of the housing 2. The ribs 17 and projection 18 are used for supporting the housing 2 on the circuit board so that, especially when an attachment plug is plugged in or unplugged, tilting motion of the connector 1 is prevented. In the electrical connector 1 which is shown in FIG. 1 and which has a plurality of contact elements 3 which are located next to one another, and therefore can also be called a plug strip, the receiving space 6 of the first contact element 3, which is the only one shown here, is separated by a housing partition 19 from the receiving space 6 which lies behind and the contact element 3 which is located behind it.

What is claimed is:

1. Electrical connector for surface mounting on circuit boards, comprising;

a housing and at least two contact elements which are located next to one another, the contact elements each having a contact leg and a first solder terminal leg arranged essentially perpendicularly to each other, and the contact legs each projecting into a receiving space in the housing and the solder terminal legs each running along a first outer side of the housing, wherein the first solder terminal legs are each connected, on one end, in one piece to at least one second solder terminal leg, the at least one second solder terminal leg running perpendicular to the first solder terminal legs and parallel to the contact legs along a second outer side of the housing, wherein, on a side of at least one of the first solder terminal legs and the second solder terminal legs opposite the housing, at least one projection is provided for making respective electrical contact with the circuit board, and wherein on the side of at least one of the first solder terminal legs and the second solder terminal legs opposite the housing, at least one projection is provided for mechanical fixing to a circuit board.

2. Electrical connector as claimed in claim 1, wherein the contact elements are stampings.

3. Electrical connector as claimed in claim 1, wherein the projections are arranged uniformly distributed over the length of the first solder terminal leg and of the second solder terminal leg.

4. Electrical connector as claimed in claim 1, wherein the contact legs are each arranged in the area of the center of the first solder terminal leg.

5. Electrical connector as claimed in claim 1, wherein at least one catch lug is provided on the side of the second solder terminal legs facing the housing and a corresponding catch projection is provided on the second outer side of the housing.

6. Electrical connector as claimed in claim 1, wherein at least one projection is provided on at least one of the first outer side and the second outer side of the housing.

7. Electrical connector as claimed in claim 1, wherein at least a number of holes which corresponds to the number of contact elements is made in the first outer side of the housing wherein the contact legs each project through a respective hole into a receiving space in the housing, the holes each being connected to a tap which projects into the receiving space and by which the contact legs, and thus the contact elements, are fixed on the housing.

8. Electrical connector as claimed in claim 7, wherein at least one catch lug is provided on the side of the second solder terminal legs facing the housing and a corresponding catch projection is provided on the second outer side of the housing.

9. Electrical connector for surface mounting on circuit boards, comprising:

a housing and at least two contact elements which are located next to one another, the contact elements each having a contact leg and a first solder terminal leg arranged essentially perpendicularly to each other, and the contact legs each projecting into a receiving space in the housing and the solder terminal legs each running along a first outer side of the housing, wherein the first solder terminal legs are each connected, on one end, in one piece to at least one second solder terminal leg, the at least one second solder terminal leg running perpendicular to the first solder terminal legs and parallel to the contact legs along a second outer side of the housing, wherein, on a side of at least one of the first solder terminal legs and the second solder terminal legs opposite the housing, at least one projection is provided for making respective electrical contact with the circuit board, and wherein at least a number of holes which corresponds to the number of contact elements is made in the first outer side of the housing, wherein the contact legs each project trough a respective hole into a receiving space in the housing, the holes each being connected to a tap which projects into the receiving space and by which the contact legs, and thus the contact elements, are fixed on the housing.

10. Electrical connector as claimed in claim 9, wherein at least one catch lug is provided on the side of the second solder terminal legs facing the housing and a corresponding catch projection is provided on the second outer side of the housing.

11. Electrical connector for surface mounting on circuit boards, comprising:

a housing and at least two contact elements which are located next to one another, the contact elements each having a contact leg and a first solder terminal leg arranged essentially perpendicularly to each other, and the contact legs each projecting into a receiving space in the housing and the solder terminal legs each running along a first outer side of the housing, wherein the first solder terminal legs are each connected, on one end, in one piece to at least one second solder terminal leg, the at least one second solder terminal leg running perpendicular to the first solder terminal legs and parallel to the contact legs along a second outer side of the housing, wherein, on a side of at least one of the first solder terminal legs and the second solder terminal legs opposite the housing, at least one projection is provided for making respective electrical contact with the circuit board, and wherein at least one catch lug is provided on the side of the second solder terminal legs facing the housing and a corresponding catch projection is provided on the second outer side of the housing.

* * * * *